US006317580B1

(12) United States Patent
Eyschen

(10) Patent No.: US 6,317,580 B1
(45) Date of Patent: Nov. 13, 2001

(54) PRINTING SYSTEM FOR PARALLEL PRINTING WITH OFFSET PRINTING SIDES ON TWO RECORDING MEDIA

(75) Inventor: Thomas Eyschen, Haar (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/630,098

(22) Filed: Aug. 1, 2000

(30) Foreign Application Priority Data

Oct. 29, 1999 (DE) ..... 299 19 094 U

(51) Int. Cl.[7] ..... G03G 15/00
(52) U.S. Cl. ..... 399/384; 399/407
(58) Field of Search ..... 399/384, 385, 399/407, 404; 270/5.02, 12, 18, 58.18; 242/615, 615.1; 347/104

(56) References Cited

U.S. PATENT DOCUMENTS 4,941,377 * 7/1990 Ishihara et al. ..... 399/385 X
5,061,967 * 10/1991 Isobe ..... 399/385 X
5,348,277 * 9/1994 Crowley ..... 270/39.05
5,713,071 * 1/1998 Hausmann ..... 399/384 X
6,120,142 * 9/2000 Eltgen et al. ..... 347/104

FOREIGN PATENT DOCUMENTS 0 696 364 B1 2/1996 (EP) .
0 699 315 B1 3/1996 (EP) .
08-059070 * 3/1996 (JP) .
08-240939 * 9/1996 (JP) .

* cited by examiner

*Primary Examiner*—Sophia S. Chen
(74) *Attorney, Agent, or Firm*—Schiff Hardin & Waite

(57) ABSTRACT

A print system electrographically prints two web shaped recording media which are then sent to a post-processing station. The print sides of the two recording media are offset from one another by a distance and the two recording media are crossed so that they overlie one another after leaving the printer and upon entry into the post-processing station.

2 Claims, 1 Drawing Sheet

PRINTING SYSTEM FOR PARALLEL PRINTING WITH OFFSET PRINTING SIDES ON TWO RECORDING MEDIA

BACKGROUND OF THE INVENTION

1. Field of the Invention

The present invention concerns an electrographic printing system for the printing of web-shaped recording media, whereby a first web-shaped recording medium and at least a second web-shaped recording medium are fed to a transfer station having a single intermediate carrier carrying toner images, whereby toner images of respectively same long print sides are transferred onto both recording media arranged side by side.

2. Description of the Related Art

An electrographic printing means is known from Patent Document EP-A 0 699 315, whereby a intermediate carrier, e.g. a photoconductor drum, has double the width of a web-shaped recording medium. Thus, it is possible to simultaneously print two recording media lying side by side. The two recording media are transported parallel through the printing means and are respectively provided with toner images on the side lying across from the intermediate carrier. Both web lines can then be fixed in one single fixing station.

A feeder means for single sheets is disclosed in European Patent Document EP-A 0 696 364. The single sheets are fed to a diplexer that distributes the single sheets onto two transport paths. A printing means having double the width of a single sheet prints the single sheets, which are carried away in parallel on the two transport paths. After printing, the single sheets of the two transport paths are fed anew to a diplexer which feeds the single sheets onto a single transport path and moves the sheets further. The single sheets are then stacked together.

SUMMARY OF THE INVENTION

It is an object of the invention to provide an electrographic printing means which simplifies the transport of at least two web-shaped recording media and enables flexible further processing.

This object and others are achieved by the printing system for first and second web-shaped recording media which are fed to a transfer station, including a single intermediate carrier carrying the toner images. The toner images are transferred onto both recording media side-by-side. The print sides of the two recording media are offset from one another. A post processing station is provided into which the printed first and second recording media is fed so that both are processed simultaneously in the post-processing station.

As an improvement, the print sides of the two recording media become congruent prior to or in the post-processing station in a longitudinal direction. Preferably, the two recording media are identical to one another. It is also contemplated that the content being printed on the two recording media is identical.

In one embodiment, the distance between the print sides of the two recording media is selected to permit sagging loops of the recording media to form between the printer and the post-processing station. The two recording media cross at the post-processing station and are transported consequently with respect to their print sides into the post-processing station. The distance may be selected to be a length of one print side.

The present invention finds particular utility when a first form is printed on the first recording media and a second form is printed on the second recording media and the two forms are overlaid to create a manifold set.

In one embodiment, the post-processing station is a cutting station that simultaneously cuts the two recording media overlying one another. The post-processing station also stacks the cut sheets together.

A control is provided for the printing system that simultaneously receives the print data for the two recording media and the control delays the printing of the print side of the second recording media corresponding to the length of the distance between the print sides.

According to the invention, the print sides of the first recording medium path and of the second recording medium path are printed offset by a distance. This distance is then compensated in turn during the further transport of the two recording medium paths to a post-processing station. In this fashion, the path length is extended by the distance for a recording medium path, whereby it is possible, to lay, for example, both recording medium paths over one another. Accordingly, both recording medium paths are simultaneously processed in the post-processing station. This post-processing station can then have a narrower width than the sum of the widths of the recording medium paths. The guidance of the two recording medium paths is simplified, whereby the equipment costs are reduced. The printing means according to the present invention can be flexibly used for various application purposes due to the improved path guidance. It is possible, for example, to simultaneously cut both recording media together into single sheets by overlaying the two recording media paths.

The two recording media paths can be different; for example, the one recording media path may be used for cover sheets and can be provided with increased weight paper, while the other recording media path is used for manifold paper and may have a reduced weight paper. In accordance with one exemplary embodiment, however, both recording media paths can be the same. In this instance, a high printing volume can be attained as a result of parallel printing, whereby both recording media paths are fed together after leaving the printer and can be moved onward on one single transport path.

In accordance with a further exemplary embodiment, the distance between the print sides of the first recording media path and the second recording media path is selected such that sagging loops for the recording media form between the printing means and the post-processing station, whereby the two recording media cross while being fed to the post-processing station and, with respect to the print side, are congruently transported into the post-processing station. The distance preferentially amounts to the length of a print side. As a result of this step, a simple transport of both recording media paths is attained with limited equipment costs.

BRIEF DESCRIPTION OF THE DRAWINGS

An exemplary embodiment of the invention is illustrated in the following on the basis of the drawings.

DETAILED DESCRIPTION OF THE PREFERRED EMBODIMENTS

Figures 1, 2:
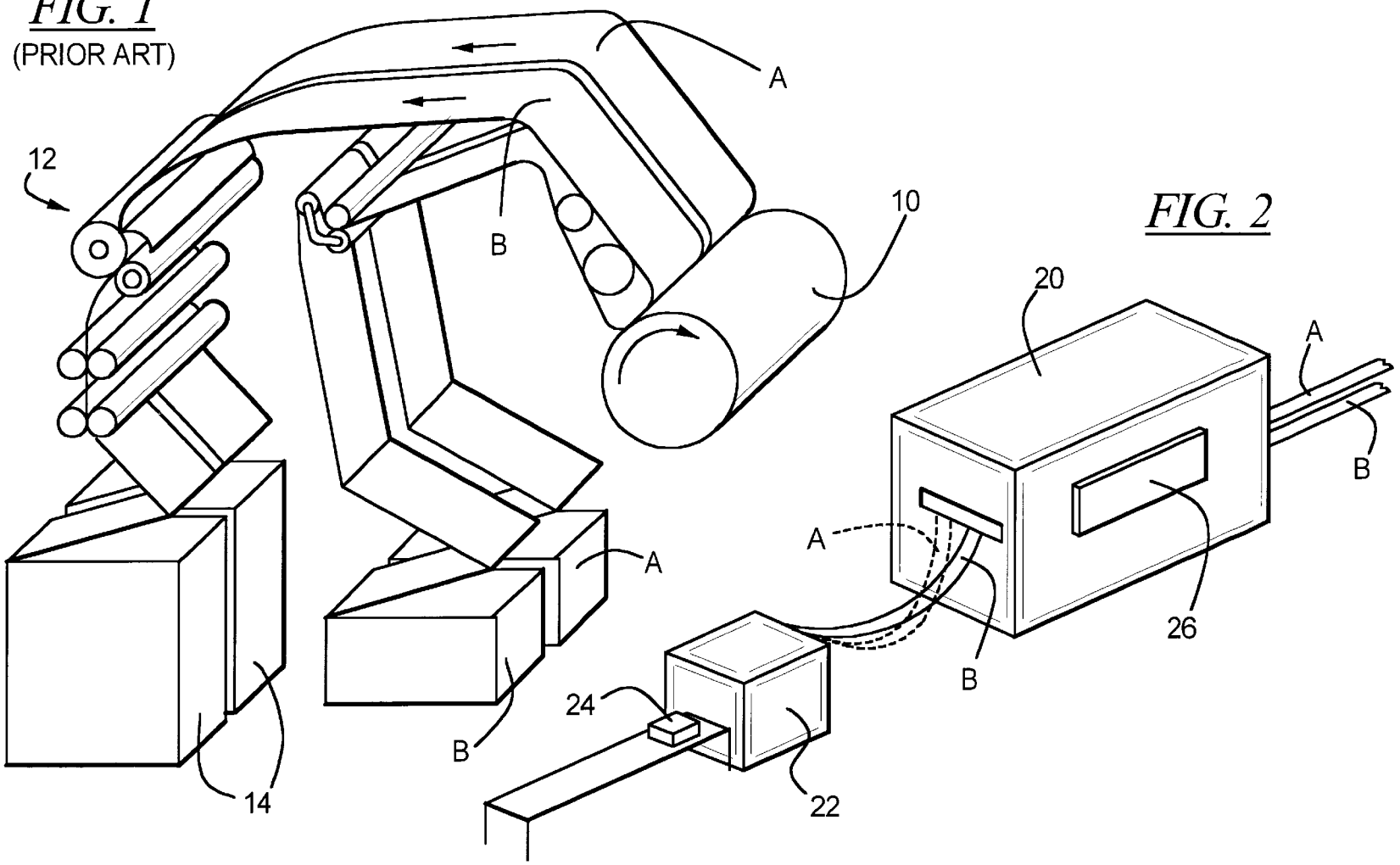
FIG. 1 (PRIOR ART)
FIG. 1 is a side perspective view of the layout of a conventional printing means with parallel printing on two recording media paths.
FIG. 2 is a top perspective view of a printing means and a post-processing station that are fed two recording media paths with congruent print sides according to the invention.

FIG. 1 shows an electrographic printing device for printing two web-shaped recording media A and B. The recording media A and B can have differing widths. The recording media A and B are fashioned as fan-fold-paper that has a one fold respectively between two sequential print sides. However, webs without folds can also be used as the recording media. The recording media A and B are fed to an electromotor-driven photoconductor drum 10 and are simultaneously printed there. Instead of the photoconductor drum 10, a web-shaped intermediate carrier can also be used. The two recording media A and B are fed via a roller arrangement 12 after being printed to a stack 14 and are deposited there. Further details of the layout of the printing means can be derived from the European Patent Document EP-A- 0 699 315 from the same applicant that is included in the present application by a reference as a further disclosure source.

FIG. 2 shows a printing means 20 as an exemplary embodiment of the invention wherein the recording media paths A and B are printed simultaneously and in parallel. The printing ensues such that the print sides of the first recording media paths A and the print sides of the second recording media paths B are offset by the length of a print side, for example, by the length of a page. The printed recording media paths A and B that are output from the printing means 20 are fed to a cutting station 22. The two recording media paths A and B are thereby overlaid on the print side so that the print sides are congruent to one another. The recording media paths A and B form sagging loops along the pathway between the printing means 20 and the cutting station 22, whereby the two recording media paths A 44 and B cross at side edges turned toward each other at the feed into the cutting station 22. Once in the cutting station 22, both recording media paths A and B overlay each other with their print sides congruent and are cut together into single sheets 24 that are then deposited on a stack. Due to the selected distance, or respectively, the offset of the print sides during parallel printing in the printing means, a trouble-free common guidance of the recording media paths A and B is enabled. Collision of the recording media paths A and B is prevented due to the loop formation, whereby the loops have differing sag levels. Feeding the recording media paths A and B congruently one over the other is also improved due to the distance set between the print sides because the required, relative, lateral offset of the recording media paths A and B is reduced as a result of the loop length.

The control 26 of the printing means 20 is appropriately programmed to set the distance. This control 26 receives the print data for the print sides of the recording media path A and the recording path B at the same time for the printing process, this control 26 initiates that the print sides of the recording media path B are printed with a delay. The delay is set dependent on the distance, e.g. a print side. recording media path B at the same time. For the printing process, this control initiates that the print sides of the recording media path B are printed with a delay. The delay is set dependent on the distance, e.g. a print side.

A preferred application of the invention is that a first form is printed on the recording media path A and a second form on the recording media path B. After bringing the two recording media paths A, B together and cutting them together, the overlaying forms create a manifold set.

Although other modifications and changes may be suggested by those skilled in the art, it is the intention of the inventor to embody within the patent warranted hereon all changes and modifications as reasonably and properly come within the scope of their contribution to the art.

I claim:

1. An electrographic printing system for printing a first web-shaped recording medium and at least a second web-shaped recording medium in a printer, comprising:

a transfer station in the printer having a single intermediate carrier carrying toner images into which said first and second recording media are fed, said transfer station being operable to transfer toner images of print sides onto both said first and second recording media arranged side by side;

first and second recording media paths being shaped to offset the print sides of the first and second recording media by a predetermined offset distance; and a post-processing station to which the first recording medium and the second recording medium are fed after being printed, the offset distance in the post-processing station being at least approximately zero and both recording media being simultaneously processed in the post-processing station;

wherein the predetermined offset distance between the print sides of the first recording medium and of the second recording medium is selected such that sagging loops form for the recording media between the printer and the post-processing station, the two recording media cross at a feed to the post-processing station and are congruently transported into the post-processing station in respect to the print sides.

2. An electrographic printing system according to claim 1, further comprising:

a control for the printing system which simultaneously receives print data for print sides of the first and the second recording medium, and the control delaying the printing of the print side of the second recording medium corresponding to the length of the offset distance.

* * * * *